US007677681B2

(12) United States Patent
Cheon

(10) Patent No.: US 7,677,681 B2
(45) Date of Patent: Mar. 16, 2010

(54) KIMCHI REFRIGERATOR

(75) Inventor: Sang-Hyun Cheon, Changwo-si (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 11/406,237

(22) Filed: Apr. 19, 2006

(65) Prior Publication Data

US 2006/0250061 A1 Nov. 9, 2006

(30) Foreign Application Priority Data

Apr. 20, 2005 (KR) ..... 10-2005-0032912
Apr. 26, 2005 (KR) ..... 10-2005-0034322

(51) Int. Cl.
*A47B 96/04* (2006.01)

(52) U.S. Cl. ..... 312/406; 312/400; 312/401; 312/237; 220/62.17; 220/62.18; 62/440; 62/443; 62/446

(58) Field of Classification Search ..... 62/440, 62/443, 446; 220/62.17, 62.18; 312/400, 312/401, 406, 237
See application file for complete search history.

(56) References Cited

U.S. PATENT DOCUMENTS 122,089 A * 12/1871 Westlake ..... 220/62.16
3,096,905 A * 7/1963 Kenney ..... 220/270
3,133,427 A * 5/1964 Petkwitz ..... 62/227
3,719,303 A * 3/1973 Kronenberger ..... 220/592.1
3,923,355 A * 12/1975 Dietterich ..... 312/406.1
4,564,001 A * 1/1986 Maeda ..... 219/621
2002/0194861 A1* 12/2002 Shin ..... 62/440

* cited by examiner

*Primary Examiner*—Frantz F Jules
*Assistant Examiner*—Azim Rahim
(74) *Attorney, Agent, or Firm*—KED & Associates, LLP

(57) ABSTRACT

A refrigerator having improved cooling and cooling recovery is provided. A main body of the refrigerator may include an outer casing that defines an external appearance of the refrigerator, and an inner casing with an open upper face installed in the outer casing to define a storage space therein. The open upper face of the main body may be opened and closed by a door. The inner casing may include a casing upper portion and a casing lower portion coupled to the bottom of the casing upper portion. The casing lower portion may be formed of a material different from that of the casing upper portion. The casing upper portion may be made of a material having a high thermal conductivity, and the casing lower portion may be made of a material having a lower thermal conductivity that that of the casing upper portion.

18 Claims, 6 Drawing Sheets

KIMCHI REFRIGERATOR

BACKGROUND OF THE INVENTION

1. Field of Invention

The present invention relates to a kimchi refrigerator, and more particularly, to a kimchi refrigerator including an inner casing which is configured to maximally suppress the temperature increase in the kimchi refrigerator against an external high-temperature environment.

2. Description of the Prior Art

A perspective view of a chest-type kimchi refrigerator is shown in FIG. 1. As shown in this figure, the chest-type kimchi refrigerator (hereinafter, referred to as a kimchi refrigerator) comprises a main body 10 with an open upper face and a storage space 16, and a door 20 for allowing the open upper face of the main body 10 to be opened and closed.

Further, the main body 10 comprises an outer casing 12 made of a metal plate to define an external appearance of the refrigerator and an inner casing 14 installed in the outer casing 12 to define the upwardly opened storage space 16. An insulating layer is formed between the outer casing 12 and the inner casing 14. The inner casing 14 is made of a material with high thermal conductivity, e.g. aluminum. In addition, since the door 20 is connected to the main body 10 by hinges 22, the door is pivoted to open and close the storage space 16 of the main body 10.

As can be seen from FIG. 2, the kimchi refrigerator is mounted with a heat exchanger for generating cold air to keep foodstuffs, e.g. kimchi, stored in the inner casing 14 in a refrigerating state, and a heater necessary to ripen the kimchi. Further, in consideration of the convection of air in the storage space 16 of the kimchi refrigerator, an evaporator is installed at an upper portion on an outer periphery of the inner casing 14 and a heater is installed at a lower portion on the outer periphery of the inner casing 14. In a direct cooling type refrigerator, the evaporator is generally composed of refrigerant tubes 18 which repeatedly surround the upper portion on the outer periphery of the inner casing 14. In addition, the heater 19 is installed at the lower portion on the outer periphery of the inner casing 14. The refrigerant tubes 18 and the heater 19 provide cold air necessary to store kimchi in a refrigerating state and heat necessary to ripen kimchi, respectively.

In order to most efficiently perform the heat exchange between the refrigerant tubes 18 and the heater 19, the conventional inner casing 14 has been made of a single material with high thermal conductivity, e.g. aluminum. The refrigerant tubes 18 and the heater 19 are attached to an outer surface of the inner casing 14 by using aluminum tapes Ta and Tb or the like having high thermal conductivity.

In the conventional kimchi refrigerator so configured, the external air with relatively higher temperature is introduced in the refrigerator when the door 20 is opened to put foodstuffs into or out of the storage space. If the high temperature external air is introduced into the storage space 16, an upper portion of the inner casing 14 is exposed to a high-temperature environment. Thus, the temperature of the upper portion of the inner casing 14 made of a material with high thermal conductivity is easily increased, and the temperature of the lower portion of the inner casing 14 formed of the same material is also rapidly increased. This means that the temperature in the inner storage space defined by the inner casing 14 is substantially rapidly increased.

The conventional kimchi refrigerator so configured has the following problems. That is, the internal temperature of the refrigerator is substantially easily raised as the door is opened and closed. Thus, the freshness of foodstuffs stored in the refrigerator can be substantially reduced due to the above phenomenon and electric power consumption can also be increased.

SUMMARY OF THE INVENTION

The present invention is conceived to solve the aforementioned problems in the prior art. Accordingly, an object of the present invention is to provide a kimchi refrigerator capable of maximally suppressing the temperature increase in the refrigerator against the opening and closing of a door to allow foodstuffs to be stored in a fresh state and also electric power consumption of the refrigerator to be minimized.

According to an aspect of the present invention for achieving the object, there is provided a kimchi refrigerator which comprises a main body including an outer casing for defining an external appearance of the refrigerator, and an inner casing with an open upper face installed within the outer casing to define a storage space therein; and a door for opening and closing the open upper face of the main body. Further, the inner casing includes a casing upper portion in the form of a container with, and a casing lower portion coupled to the bottom of the casing upper portion and formed of a material different from that of the casing upper portion.

Preferably, the casing lower portion is formed of a material with lower thermal conductivity than that of the casing upper portion.

Preferably, the casing lower portion is formed of a material with lower thermal conductivity and higher specific heat than those of the casing upper portion.

Preferably, the casing lower portion is formed of a material with higher specific heat than that of the casing upper portion.

The casing upper portion may be formed of aluminum.

Further, the casing lower portion may be formed of tin.

More preferably, aluminum tapes are attached to a portion where the casing upper portion and the casing lower portion are coupled with each other.

With the inner casing of the present invention so configured, the temperature change in the storage space of the kimchi refrigerator can be minimized while the door is opened, and the storage space can be returned more rapidly to a refrigerating state when the door is closed. Therefore, there is an advantage in that it is possible to keep the stored foodstuffs fresher and simultaneously to minimize electric power consumption.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, the present invention will be described in detail with reference to the accompanying drawings.

Figure 1:
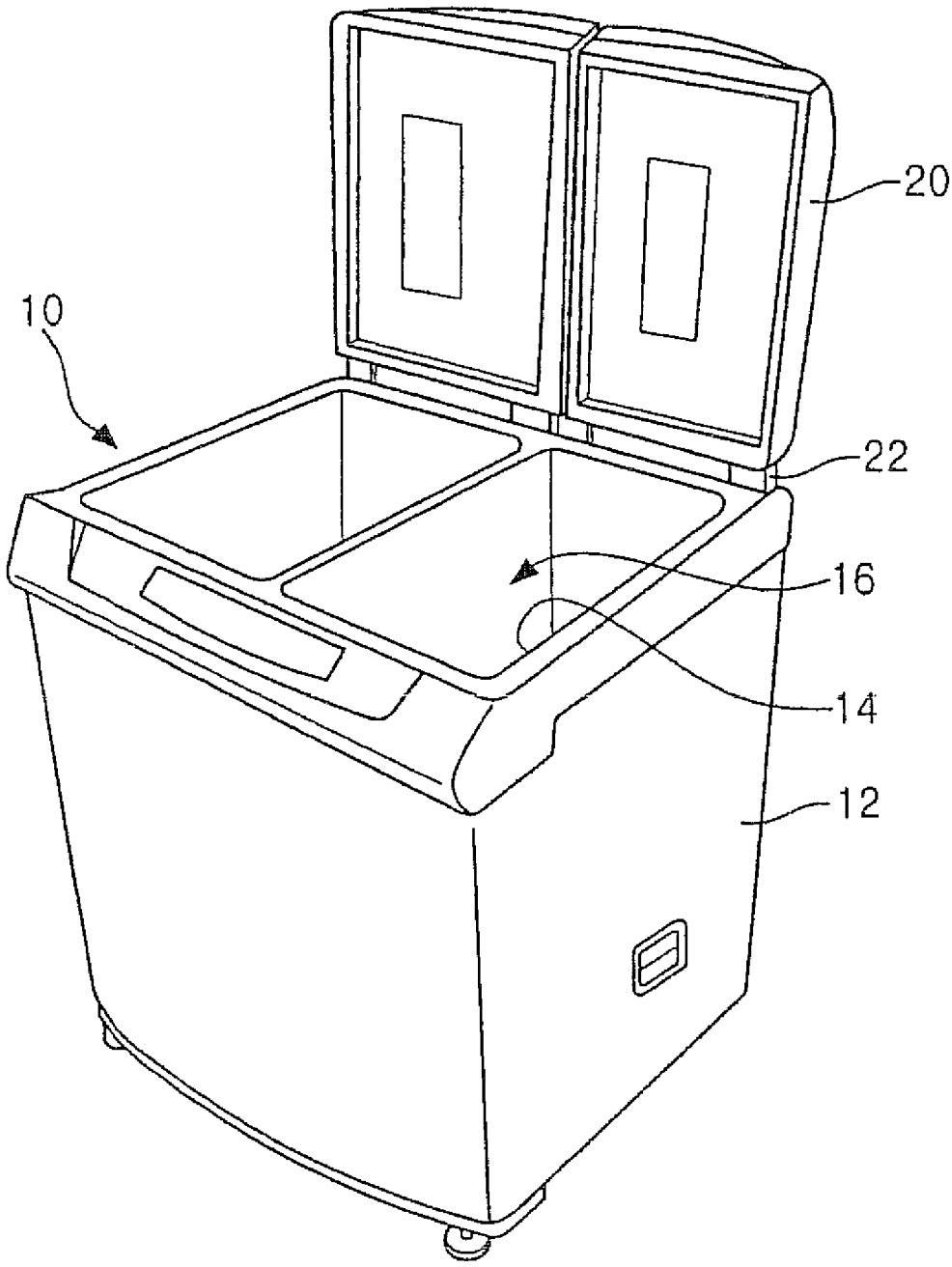
Fig. 1 PRIOR ART
FIG. 1 is a perspective view of a related art kimchi refrigerator.
Figure 2:
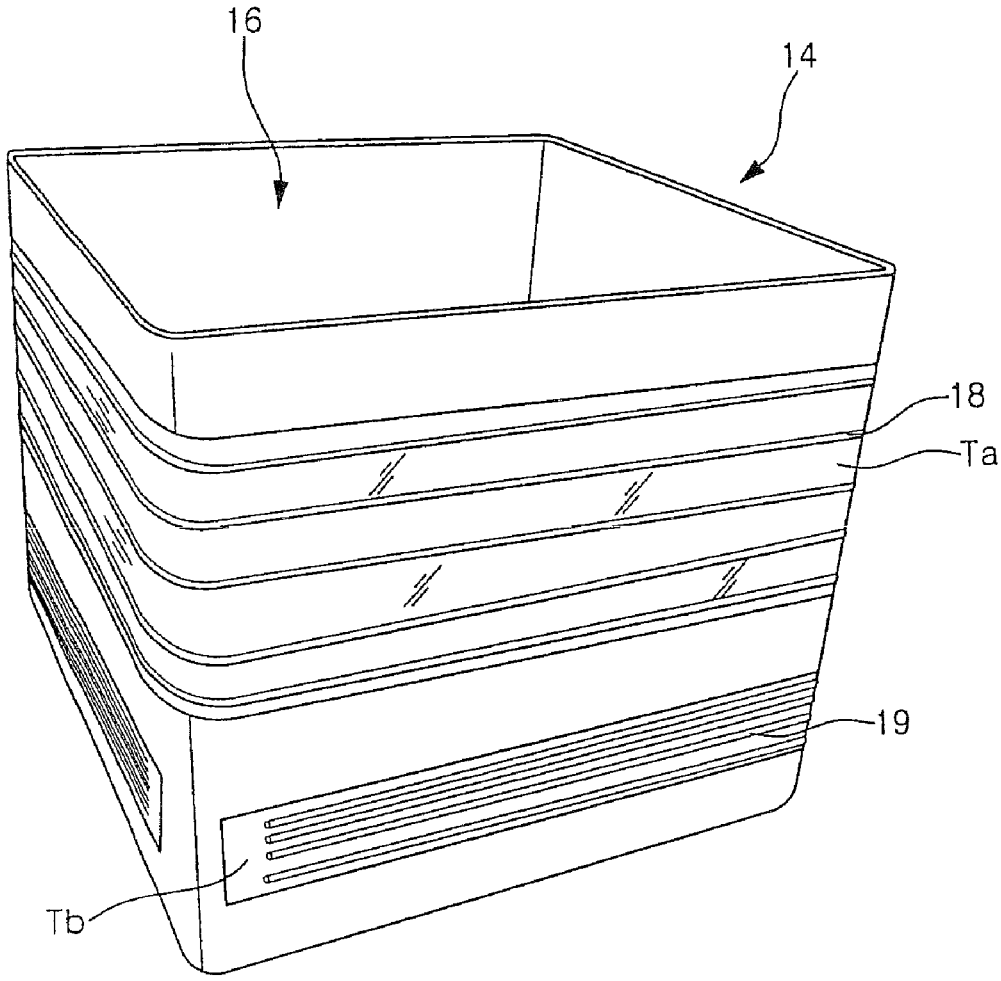
Fig. 2 PRIOR ART
FIG. 2 is a perspective view of an inner casing of the related art kimchi refrigerator.
Figure 3:
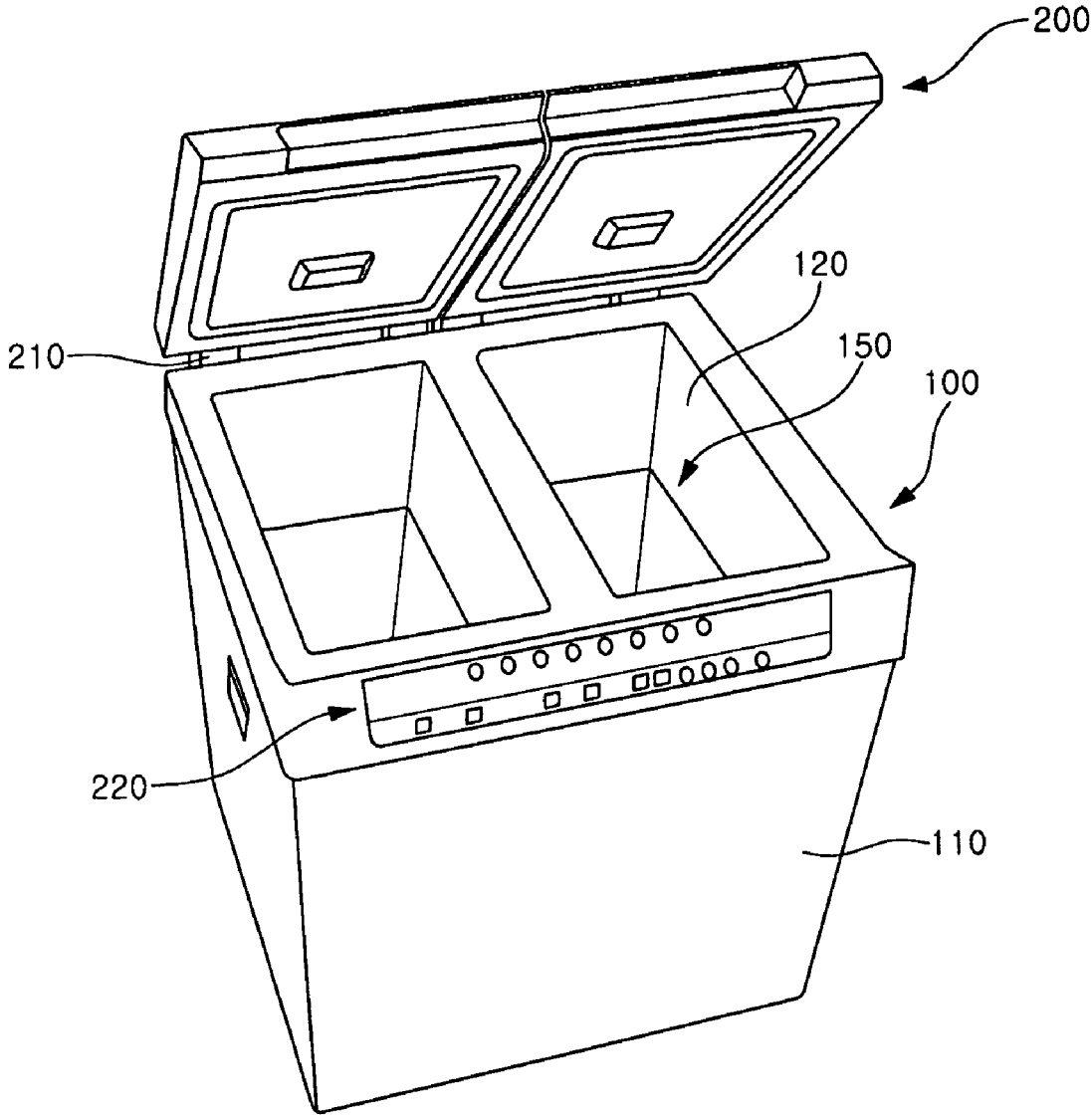
FIG. 3 is a perspective view showing a kimchi refrigerator according to the present invention in a state where its door is opened.
Figure 4:
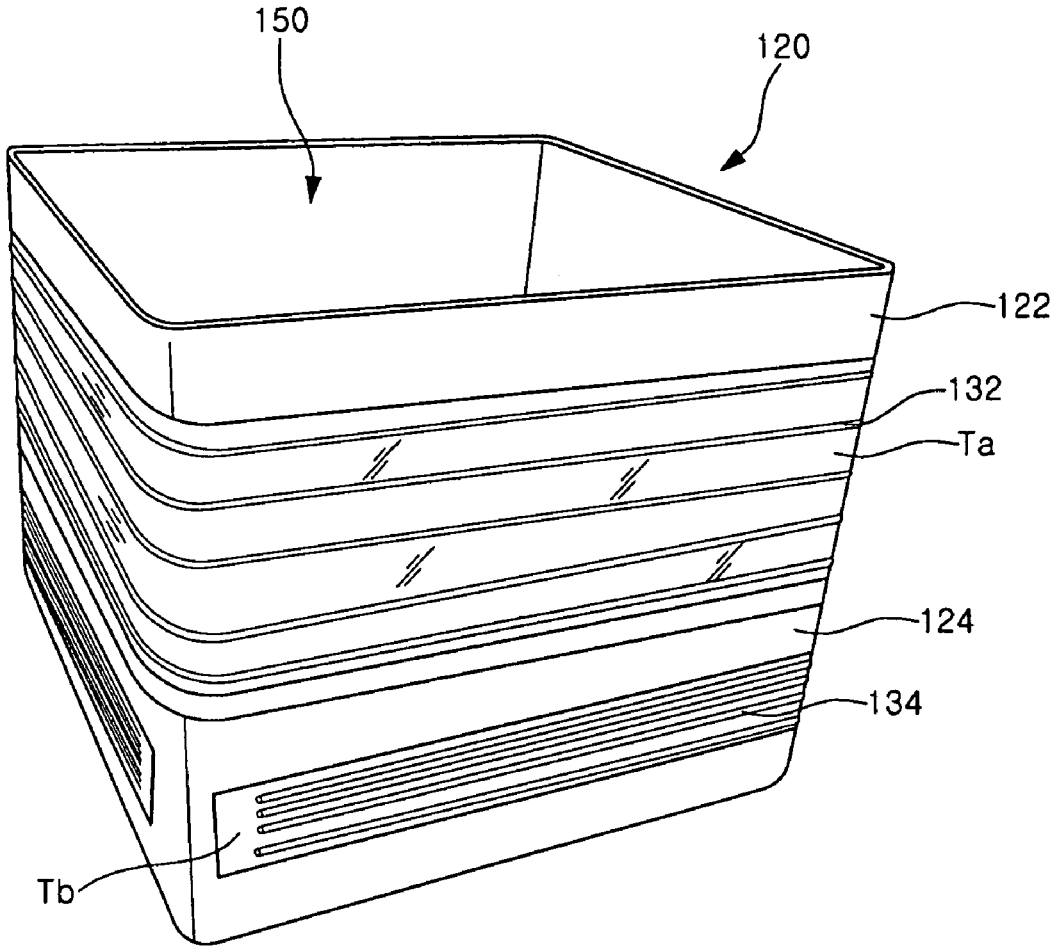
FIG. 4 is a perspective view showing an inner casing of the kimchi refrigerator according to the present invention.

FIG. 3 shows a perspective view of a kimchi refrigerator according to the present invention in a state where its door is opened, and FIG. 4 shows a perspective view of an inner casing of the kimchi refrigerator according to the present invention.

As shown in the figures, the kimchi refrigerator according to the present invention comprises a main body 100 with an open upper face and a predetermined storage space 150, and a door 200 for opening and closing the open upper face of the main body 100.

The inner parts of the door 200 and the main body 100 are formed with foam insulating layers to insulate the inside and outside of the refrigerator. The door 200 is connected to a rear end of the main body 100 via hinges 210. That is, the door is installed to open and close the storage space 150 in the main body 100 while pivoting with respect to the main body 100.

Further, the main body 100 comprises an outer casing 110 which is made of a steel plate to define an external appearance of the refrigerator and an inner casing 120 which is installed in the outer casing 110 to define the storage space 150. The outer casing 110 substantially defines the external appearance of the kimchi refrigerator. The inner casing 120 takes the shape of a container with an open upper face and substantially defines the storage space 150 of the kimchi refrigerator.

In addition, an insulating layer is formed between the outer casing 110 and the inner casing 120 by filling foam insulating materials between the casings. A control panel 220 including a plurality of operation control buttons for controlling the operation of the kimchi refrigerator, a display unit for indicating the current operating condition of the kimchi refrigerator and the like is installed at an upper end of a front surface on the main body 100.

As shown in FIG. 4, the inner casing 120 of the present invention comprises a casing upper portion 122 in the form of a container and a casing lower portion 124 coupled to the bottom of the casing upper portion 122. Once the casing upper portion 122 and the casing lower portion 124 are coupled with each other, the upwardly open inner casing 120 with the storage space 150 defined therein is finished.

Further, refrigerant tubes 132 are surrounded around an outer periphery of the casing upper portion 122. The refrigerant tube 132 serves as a heat exchanger and causes the casing upper portion 122 to be cooled by absorbing ambient heat when a liquid refrigerant flowing in the refrigerant tube is evaporated. A heater 134 is installed at the outer periphery of the casing lower portion 124. The heater 134 is installed to provide the inner casing 120 with heat necessary to ripen kimchi. In the illustrated embodiment, the refrigerant tubes 132 and the heater 134 are fixed to outer surfaces of the casing upper portion 122 and the casing lower portion 124 by using aluminum tapes Ta and Th.

The casing upper portion 122 of the present invention is formed of a material with relatively higher thermal conductivity, e.g. aluminum or copper. The casing upper portion 122 is preferably formed of aluminum in the same manner as when forming the related art inner casing. The reason that the casing upper portion 122 is formed of a material with high thermal conductivity is that the heat transfer between the casing upper portion 122 and the refrigerant tubes 132 surrounding the outer periphery of the casing upper portion can be efficiently made to more effectively cool the storage space 150 in the inner casing.

In addition, the casing upper portion 122 is preferably formed of a material with low specific heat. The reason is that the accumulation of heat due to external high-temperature air can be minimized. That is, in a case where the door 200 of the kimchi refrigerator is opened and thus the casing upper casing 122 is exposed to the external high-temperature air, the heat accumulation due to heat transfer should be minimized such that the storage space can be in a refrigerating sate as rapidly as possible when the door is closed.

Further, the casing lower portion 124 is formed of a material with relatively lower thermal conductivity and coupled to the bottom of the casing upper portion 122. The casing lower portion 124 is formed of a material with relatively lower thermal conductivity than that of the casing upper portion 122. For example, the casing lower portion 124 may be formed of a metallic material, e.g. tin, with lower thermal conductivity than that of the casing upper portion 122, or a material such as a synthetic resin or glass. The reason that the casing lower portion 124 is formed of a material with low thermal conductivity is that the heat transfer from the casing upper portion 122 can be maximally suppressed.

Tin which is used as an exemplary material of the casing lower portion 124 is a carbon group element. Thus, since tin has a property that is extremely stable in the air, it can be employed when surface plating iron, cupper or the like. Moreover, it is used as a material of a food-related apparatus as well as a biocidal and fungal agent, because of its harmlessness to the human body.

In addition, tin has a coefficient of thermal expansion (CTE) of 23.5 ppm which is the same as that of aluminum, whereas it has thermal conductivity (TC) of 73.2 W/mK which is lower than that of aluminum of 238 W/mK. Thus, it is apparent that tin is applicable to the temperature control of the inner casing 120 through the heat conduction.

Further, the casing lower portion 124 is preferably formed of a material with high specific heat. If the casing lower portion 124 is formed of a material with high specific heat, the heat transfer between the casing lower portion 124 and the casing upper portion 122 formed of a material with low specific heat can be sufficiently made. That is, after the door is opened and then closed, it is considered that the temperature of the casing upper portion 122 is relatively higher than that of the casing lower portion 124. Thus, since the heat conduction between the casing lower portion 124 formed of a material with high specific heat and the casing upper portion 122 can be sufficiently made in such a state, the inner storage space 150 can be substantially rapidly cooled.

In addition, it is preferred that the casing upper portion 122 and the casing lower portion 124 be completely contacted with and fixed to each other. In order to completely fix and tightly seal the casing upper portion 122 and the casing lower portion 124, adhesive tapes may be used in this embodiment. The tape made of a material with excellent thermal conductivity, e.g. aluminum tape, is preferably used. Alternatively, in order to form the inner casing 120 as a storage space with an open upper face by coupling the casing upper portion 122 and the casing lower portion 124 with each other, it is obvious that a variety of different means can be used in addition to the aforementioned adhesive tapes.

Figure 5:
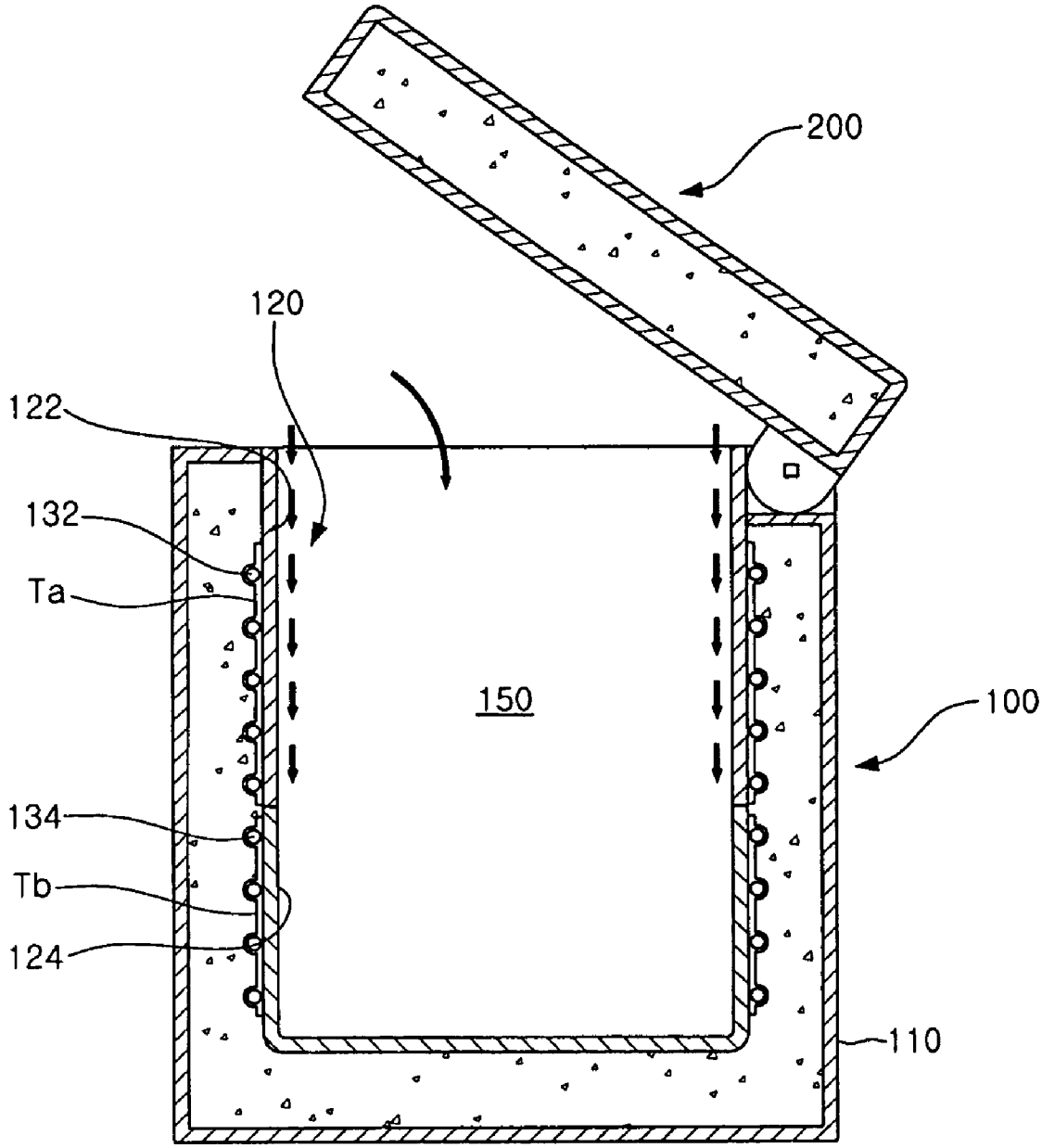
FIG. 5 is a sectional view illustrating a state where the door of the kimchi refrigerator according to the present invention is opened.

Now, the heat exchange in the kimchi refrigerator according to the present invention so configured will be described. As shown in FIG. 5, when the door 200 is opened, the casing upper portion 122 of the inner casing 120 is first exposed to external high-temperature air and the temperature thereof is increased. That is, the temperature of an upper end of the casing upper portion 122 increases due to the external air, and the heat transferred from the external air to the upper end of the casing upper portion 122 will be gradually transferred downwardly as shown by arrows. According to the present invention, however, even though the casing upper portion 122 is exposed to the external air and the temperature thereof is thus increased, the temperature change in the interior of the storage space by the external high-temperature air can be minimized since the casing lower portion 124 is formed of a material with relatively lower thermal conductivity.

Figure 6:
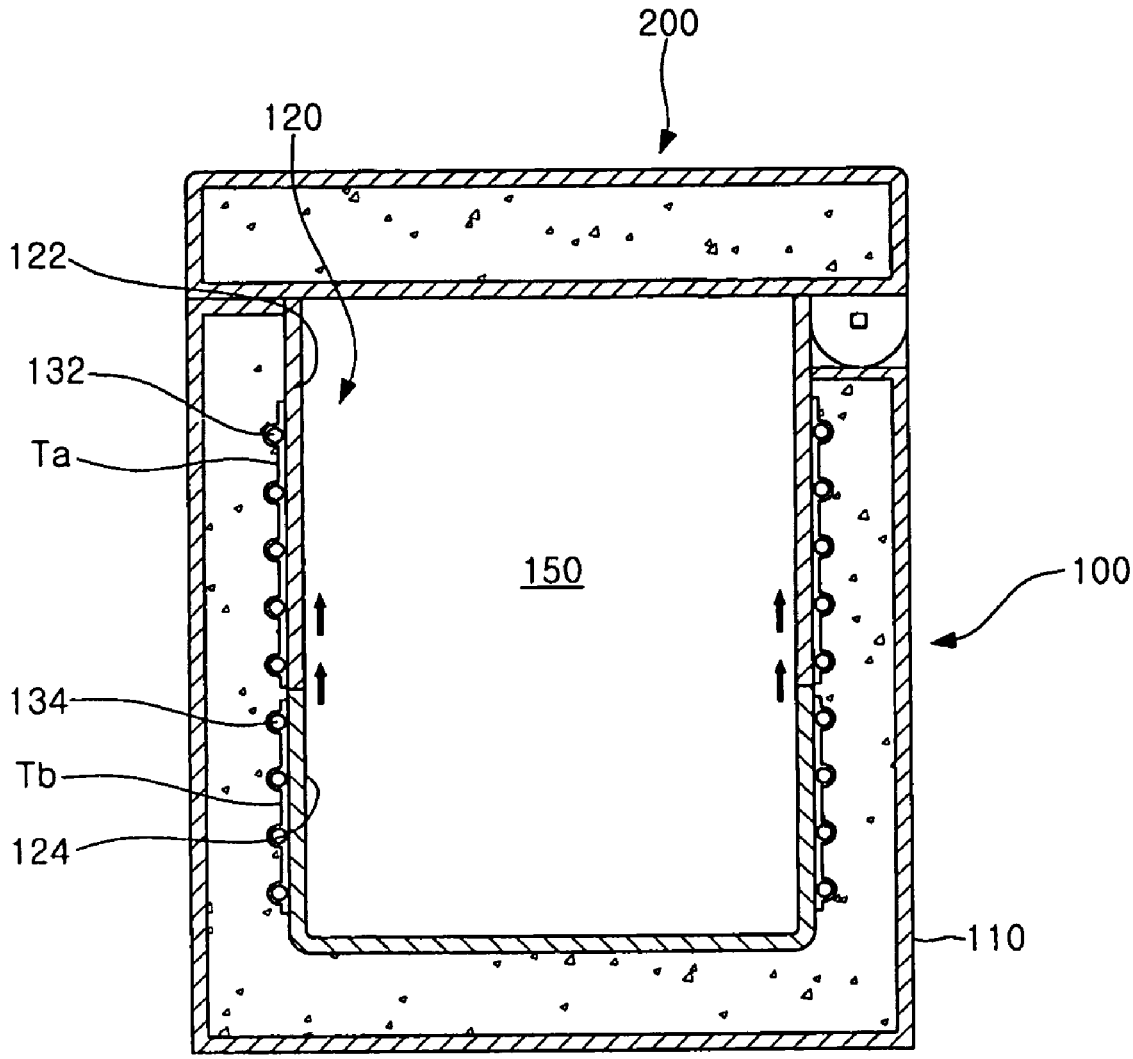
FIG. 6 is a sectional view illustrating a state where the door of the kimchi refrigerator according to the present invention is closed.

As shown in FIG. 6, when the door 200 is closed, the storage space can be returned more rapidly to a low temperature state since the casing upper portion 122 brought into contact with the refrigerant tubes 132 has high thermal conductivity. At the same time, as shown by arrows, since the casing lower portion 124 has high specific heat and the casing upper portion 122 has high thermal conductivity, the casing upper portion 122 of which the temperature is relatively high can be cooled rapidly by means of the heat exchange with the casing lower portion 124.

According to the present invention so configured, the following advantages can be expected.

When the door is opened, the casing upper portion 122 is exposed to the external air and thus the temperature thereof is increased. However, the heat transferred from the external air cannot be easily conducted to the casing lower portion 124. Thus, it is possible to prevent the temperature in a lower portion of the storage space from being easily increased. Further, when the door is closed, the casing upper portion 122 with high thermal conductivity can be rapidly cooled by means of the refrigerant tubes. In addition, since the heat transfer from the casing lower portion 124 with high specific heat to the casing upper portion 122 with low specific heat and excellent thermal conductivity can be easily made, the regions around and the storage space in the casing upper portion 122 are more rapidly kept in a refrigerating state. Therefore, since the temperature of the storage space can be rapidly returned to a low temperature state even when the temperature thereof is changed due to the opening and closing of the door, there is an advantage in that the temperature change in the storage space can be minimized and its refrigerating state can be kept more uniform. Furthermore, the change in temperature of the storage space due to the opening and closing of the door can be substantially minimized. Accordingly, there is another advantage in that it is possible to keep the stored foodstuffs relatively fresh and simultaneously to minimize electric power consumption.

It is apparent to those skilled in the art that various changes and modifications can be made thereto within the scope of the fundamental technical spirit of the present invention. Therefore, the true scope of the present invention should be construed on the basis of the appended claims.

What is claimed is:

1. A refrigerator, comprising:

an outer casing that defines an external appearance of the refrigerator;

an inner casing having an open upper face, wherein the inner casing is installed within the outer casing so as to define a storage space therein, wherein the inner casing comprises:

a casing upper portion having open top and bottom faces and four closed lateral side faces; and a separate casing lower portion having an open top face, a closed bottom face, and four closed lateral side faces, wherein an outer peripheral portion of the open top face of the casing lower portion is coupled to a corresponding outer peripheral portion of the open bottom face of the casing upper portion so as to form the storage space within the inner casing, and wherein a material of the casing lower portion has a lower thermal conductivity than a material of the casing upper portion; and a door that selectively opens and closes the open upper face of the inner casing.

2. The refrigerator of claim 1, wherein the material of the casing lower portion has a higher specific heat than the material of the casing upper portion.

3. The refrigerator of claim 1, wherein the casing upper portion is formed of aluminum.

4. The refrigerator of claim 1, wherein the casing lower portion is formed of tin.

5. The refrigerator of claim 1, further comprising an aluminum tape that couples the casing upper portion and the casing lower portion.

6. The refrigerator of claim 1, further comprising:

a plurality of refrigerant tubes provided on an outer circumferential surface of the casing upper portion; and a heating element provided on an outer circumferential surface of the casing lower portion.

7. The refrigerator of claim 6, wherein a difference in thermal conductivity of the casing upper portion and the casing lower portion prevents heat in the casing upper portion from being transferred to the casing lower portion.

8. The refrigerator of claim 1, wherein the inner casing comprises a plurality of compartments each having an open upper face, each of the plurality of compartments comprising:

a casing upper portion having open top and bottom faces and four closed lateral side faces; and a casing lower portion made of a different material than that of the casing upper portion, the casing lower portion having an open top face, a closed bottom face, and four closed lateral side faces such that the casing upper and lower portions are coupled at mating peripheral portions of their open bottom and top open faces, respectively.

9. A refrigerator, comprising:

an outer casing;

an inner casing mounted inside the outer casing, wherein a storage space is formed within the inner casing, and wherein the inner casing comprises:

a casing upper portion formed of a first material and mounted in an upper portion of the outer casing, wherein the casing upper portion has an open bottom; and a separate casing lower portion coupled to the casing upper portion so as to form the storage space formed within the inner casing, wherein the casing lower portion is formed of a second material that is different from the first material, wherein the first material has a higher thermal conductivity than the second material, and wherein the casing lower portion is mounted in a lower portion of the outer casing; and a door that selectively open and closes the storage space formed in the inner casing.

10. The refrigerator of claim 9, wherein the first material has a lower specific heat than the second material.

11. The refrigerator of claim 9, further comprising a plurality of refrigerant tubes coupled to an outer surface of the casing upper portion.

12. The refrigerator of claim 11, further comprising a heater coupled to an outer surface of the casing lower portion.

13. The refrigerator of claim 9, further comprising a heater coupled to an outer surface of the casing lower portion.

14. The refrigerator of claim 9, wherein the inner casing is shaped to form a plurality of separate storage spaces.

15. The refrigerator of claim 9, wherein the casing upper portion includes an open top and an open bottom, and wherein the casing lower portion comprises an open top and a closed bottom.

16. The refrigerator of claim 15, wherein the casing upper portion is joined to the casing lower portion with an adhesive tape.

17. A refrigerator, comprising:

an outer casing that defines an external appearance of the refrigerator;

an inner casing installed within the outer casing so as to define a storage space therein, wherein the inner casing comprises:

a casing upper portion having open top and bottom faces and four closed lateral side faces; and a casing lower portion that is separate from and coupled to the casing upper portion, wherein the casing lower portion has an open top face, a closed bottom face, and four closed lateral side faces, and wherein an outer peripheral edge of the open top face of the casing lower portion is coupled to a corresponding outer peripheral edge of the open bottom face of the casing upper portion such that corresponding outer peripheral edges of the casing upper and lower portions are flush and form a continuous internal and external contour, wherein a material of the casing lower portion has a lower thermal conductivity and a higher specific heat than a material of the casing upper portion; and a door that selectively opens and closes the storage space defined by the inner casing.

18. The refrigerator of claim 17, further comprising:

a plurality of refrigerant tubes provided on an outer circumferential surface of the casing upper portion; and a heating element provided on an outer circumferential surface of the casing lower portion, wherein a difference between the thermal conductivity of the casing upper portion and the casing lower portion prevents heat in the casing upper portion from being transferred to the casing lower portion.

* * * * *